US005638755A

United States Patent [19]

Love et al.

[11] Patent Number: 5,638,755

[45] Date of Patent: Jun. 17, 1997

[54] TROLLEY SYSTEM

[75] Inventors: Randy H. Love, Camden; Darrell Weaver, Sedalia, both of Mo.

[73] Assignee: PlaySmart, Inc., Sedalia, Mo.

[21] Appl. No.: 540,196

[22] Filed: Oct. 6, 1995

(Under 37 CFR 1.47)

[51] Int. Cl.[6] ..... B61B 13/00

[52] U.S. Cl. ..... 104/164; 104/67; 104/79; 104/89; 104/126

[58] Field of Search ..... 104/164, 53, 62, 104/67, 79, 80, 126, 89

[56] References Cited

U.S. PATENT DOCUMENTS

| | | | |
|---|---|---|---|
| 512,326 | 1/1894 | Richards . | |
| 657,166 | 9/1900 | Jones | 104/164 |
| 715,958 | 12/1902 | Booraem et al. | 104/164 |
| 740,685 | 10/1903 | Needham . | |
| 801,700 | 10/1905 | Welp . | |
| 805,991 | 11/1905 | Patterson . | |
| 1,221,371 | 4/1917 | Parr . | |
| 1,320,710 | 11/1919 | Price . | |
| 1,550,140 | 8/1925 | Bennington | 104/164 |
| 1,625,347 | 4/1927 | Bankson | 104/164 |
| 1,834,826 | 12/1931 | Burk | 104/164 |
| 1,859,180 | 5/1932 | Thiel . | |
| 1,898,466 | 2/1933 | Pierson . | |
| 2,479,715 | 8/1949 | Benlon . | |
| 4,159,113 | 6/1979 | Callecod . | |

*Primary Examiner*—Mark T. Le

*Attorney, Agent, or Firm*—David M. Klein; Bryan Cave LLP

[57] ABSTRACT

A trolley includes a track having first and second ends. A pivot is located between the first and second ends of the track so that movement of the first end of the track causes opposite movement of the second end of the track. A counterweight is located near the first end of the track so as to apply downward force. A trolley is movable along a portion of the track located between the pivot and the second end of the track. The trolley has a handle or carriage for a user. The combined weight of the user and the trolley overcomes the counterweight so as to move the second end of the track downward causing the trolley to move along the track toward the second end of the track. The counterforce is sufficient to move the second end of the track upward and to return the trolley to the starting position when the weight of the user is released from the trolley. The trolley moves between a first platform located near the starting position and a second platform lower than the first platform.

12 Claims, 6 Drawing Sheets

TROLLEY SYSTEM

BACKGROUND OF THE INVENTION

1. Field of the Invention

The present invention relates generally to a trolley ride for use in a children's playground, and more particularly to a trolley that is movable along a rotatable track between a first platform and a second platform that includes a pivot and a counterweight for returning the trolley to its starting position.

2. Description of the Prior Art

Play systems for children are well-known in the art and have evolved into a major industry in the United States. A typical play system is constructed of a tubular metal frame and may include, for example, one or more enclosed or unenclosed slides, platforms at different heights, enclosed or unenclosed passageways, a ball bin, monkey bars and other recreational elements suitable for use by children.

One such recreational element is a so-called trolley ride, which includes a trolley that is movable along a track between a first platform and a second platform that is lower than the first platform. A child grasps the trolley and jumps from the first platform, causing the trolley to slide along the track to the second platform. In order to return the trolley to its starting position adjacent to the first platform, several techniques are used.

In one such technique, as shown in FIG. 5, the trolley 72 is attached to a pair of cords 70 which wraparound a drum 74. A third cord 76 is attached to a counterweight (not shown). As the trolley 72 moves down the fixed position track toward the second platform, the counterweight is lifted by the wrapping of cord 76 around a small drum 78. When the weight on the trolley is released, the counterweight causes drum 74 to rotate so as to return the trolley carriage 72 to its starting position. This type of trolley return mechanism is not desirable because i) the cords tend to break under prolonged use, and ii) the mechanical elements of the system require substantial maintenance.

Other types of trolley systems are shown, for example, in U.S. Pat. Nos. 801,700; 1,859,180; and 4,159,113. These trolley systems either do not include automatic return mechanisms, or rely upon complex mechanical return mechanisms that are not practical in a commercial play system.

Other types of devices, generally used for amusement purposes, employ a carriage that is movable along a track and a pivot mechanism, similar to a see-saw, to move the carriage from one end of the track to the other. Such devices are shown in, for example, U.S. Pat. Nos. 512,326; 740,685; 805,991; 1,221,371; 1,320,710; 1,898,466; and 2,479,715. These types of devices are generally either manually operated, or rely upon mechanical systems that require substantial size and maintenance, neither of which are desirable in a commercial play system.

Accordingly, it is an object of the present invention to provide a trolley system that is movable between a first and second platform and which employs a return mechanism that is not mechanically complex, that requires little maintenance, and that requires no manual intervention.

SUMMARY OF THE INVENTION

The present invention is a trolley, preferably for use as a recreational device, that includes a rotatable track having first and second ends. A pivot is located between the first and second ends of the track so that movement of the first end of the track causes movement of the second end of the track in the opposite direction. A counterforce is located toward the first end of the track. The counterforce applies a downward force to the first end of the track. A trolley is movable along a portion of the track located between a starting position, which itself is located between the pivot and the second end, and the second end of the track. The trolley includes user riding means, such as a handle or carriage, which the user grasps or climbs into. The combined weight of the user and the trolley is sufficient to overcome the counterforce so as to move the second end of the track downward. This downward movement causes the trolley to move along the track toward the second end under the force of gravity. The counterforce is sufficient to move the second end of the track upward and to return the trolley to the starting position when the weight of the user is released from the trolley.

The counterforce may be a counterweight attached to the first end of the track or a spring or pulley mechanism. The trolley includes a wheel assembly movable on or within the track. The pivot may be mounted above or below the track. The trolley moves between a first platform located near the starting position at a height at which the user riding means is within reach of the user, and a second platform within reach of a user from the user riding means when the track is in a downward position. Shock absorbers may be used to dampen movement of the track, and a guide track may be used for stabilizing the second end of the track. End-stops, which include springs and/or resilient bumpers, are positioned at the starting position of the trolley and at ending position of the trolley, i.e., the second end of the track.

DESCRIPTION OF THE PREFERRED EMBODIMENT

Figure 2:
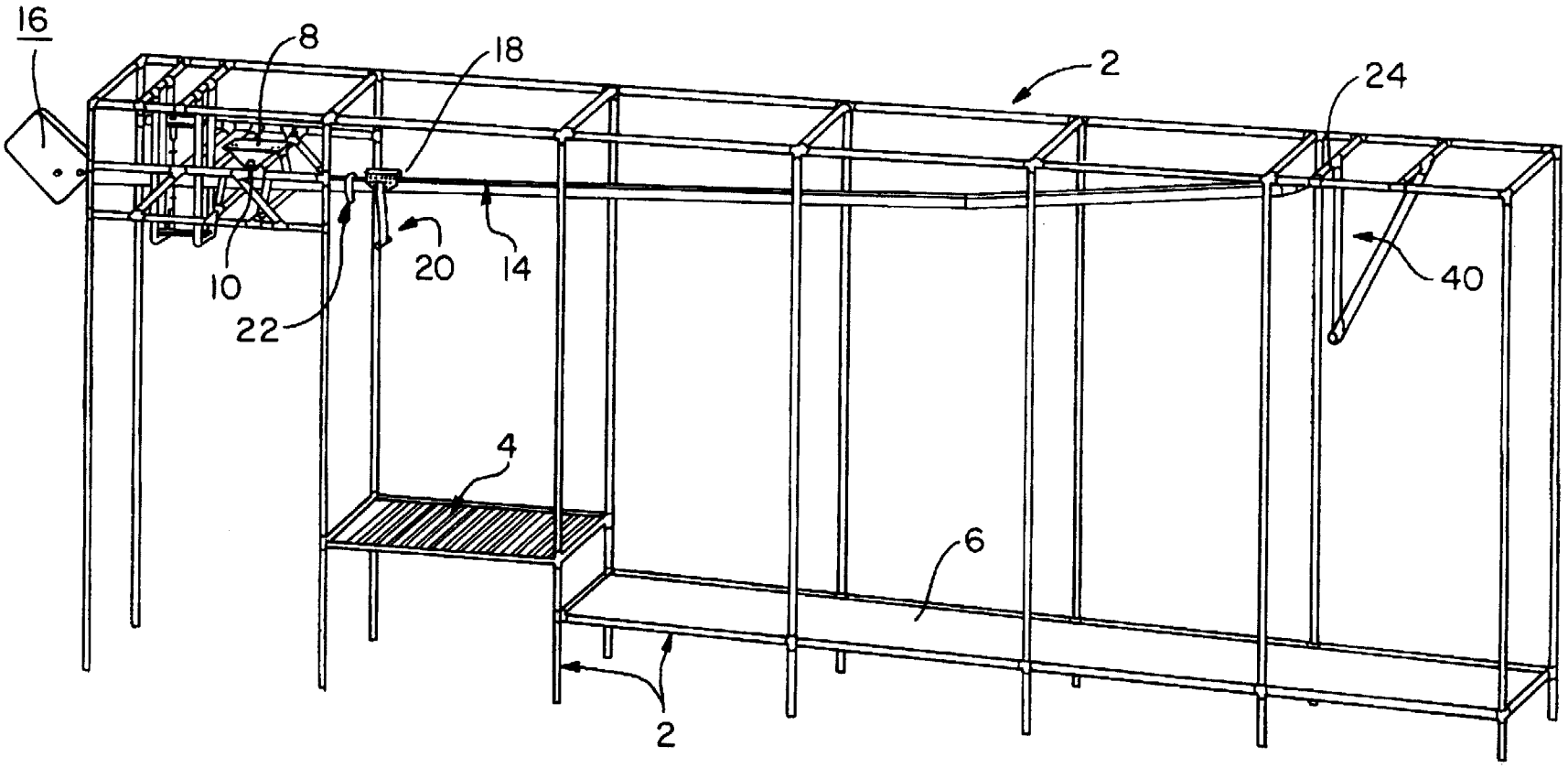
FIG. 2 is a perspective view of the trolley system of the present invention.

As shown in FIG. 2, the present invention is a trolley system, preferably for use in a playground system. The playground system is constructed of frame members 2, preferably 1.66" OD recreational structural tubing, although any appropriate framing members may be used. Frame members 2 define an upper platform 4 and a lower platform 6. Each of the upper and lower platforms 4 and 6 are formed of webbing, canvas, or other appropriate flooring material.

Figure 1:
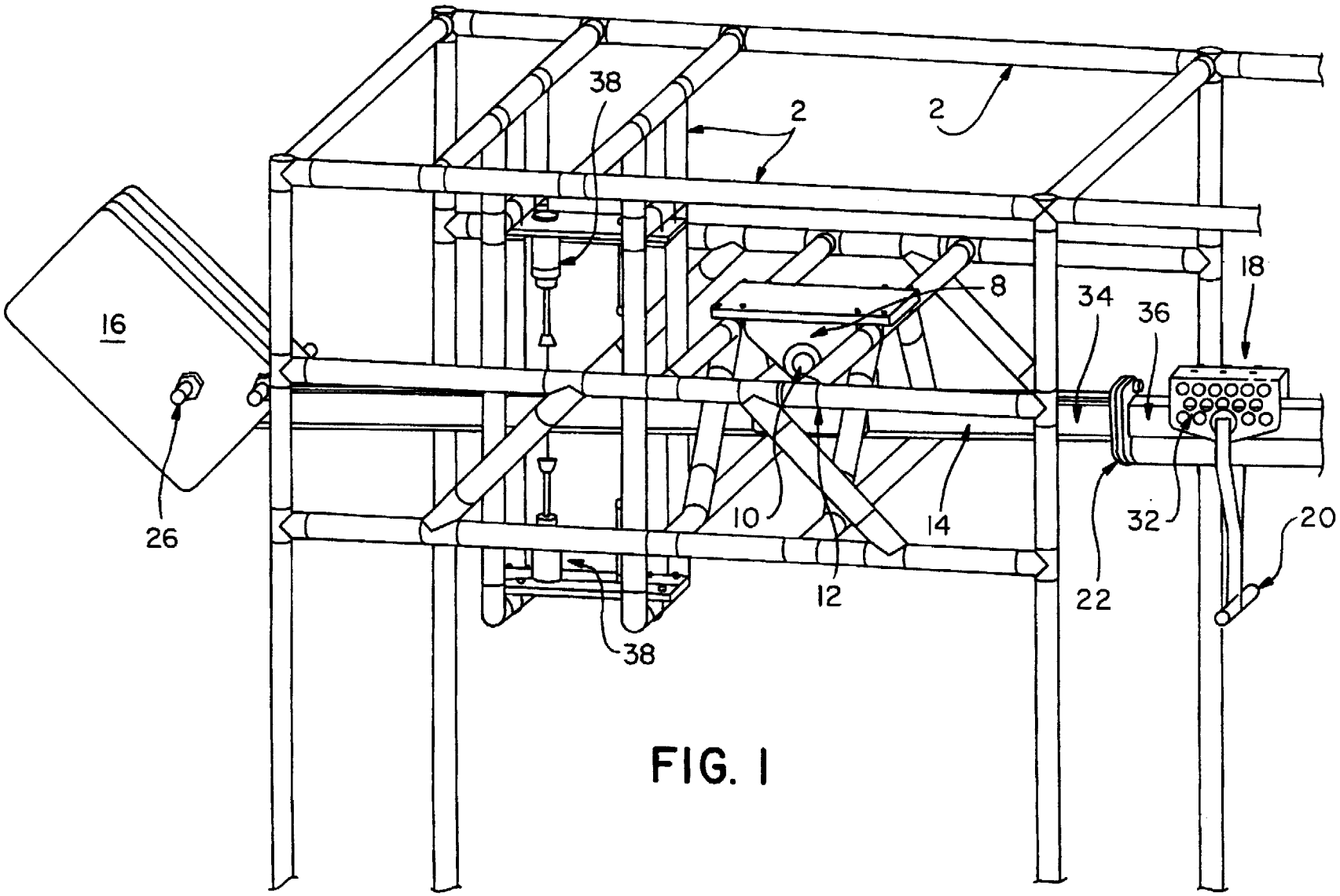
FIG. 1 is a partial perspective view of the trolley system of the present invention.

As shown in detail in FIG. 1, a frame pivot bracket 8 is fixedly attached to frame members 2 by means of bolts, brackets, or any suitable attachment means. Pivot bracket 8 includes a hole extending therethrough for receiving a pivot pin 10. A track pivot bracket 12, which is fixedly attached to track 14 is pivotally attached to bracket 8 by means of pivot 10. The pivot brackets 8 and 12 cooperate with pivot pin 10 to enable track 14 to rotate or pivot relative to frame 2.

Figure 7:
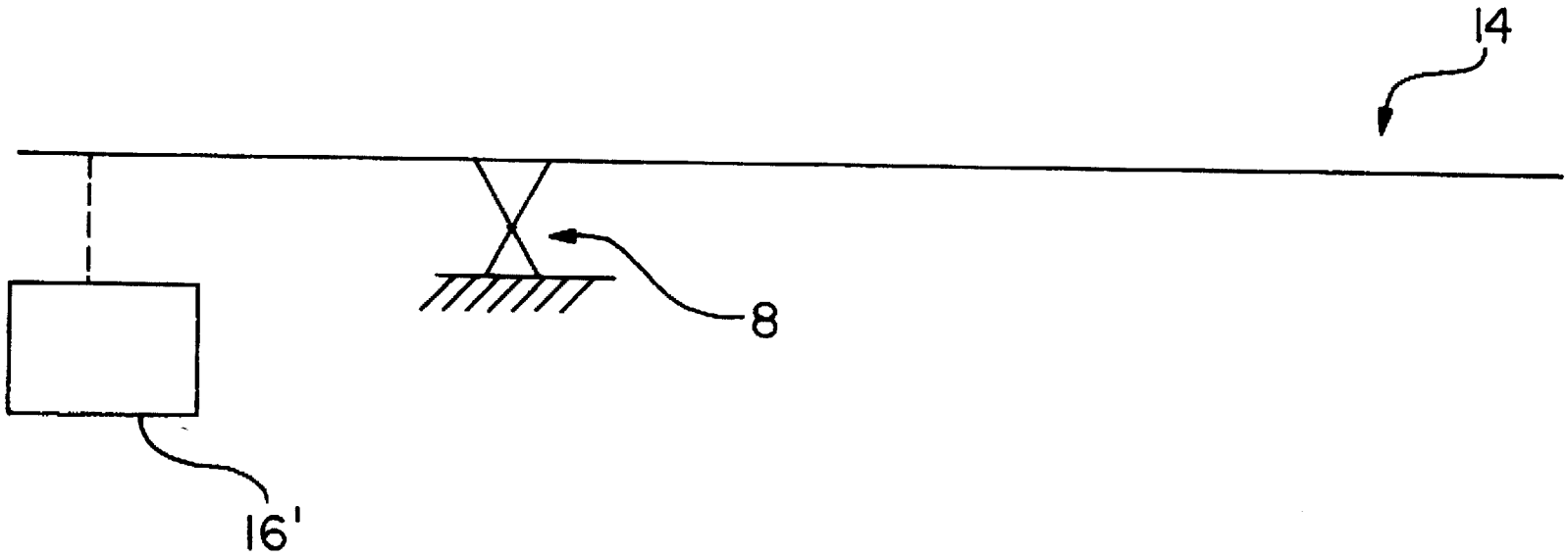
FIG. 7 is a simple diagram of an alternative embodiment of the invention.

A counterweight 16 is fixedly attached to track 14 at one end thereof. Counterweight 16 is preferably constructed of steel plates, but may be constructed of any suitable material or mechanism that applies a downward force on track 14 to cause track 14 to pivot relative to frame 2. A pair of threaded bolts 26 extend through track 14, or are welded to track 14, in order to provide a mounting point for counterweight 16. It is foreseen that counterweight 16 may be mounted to track 14 by any conventionally known means. Moreover, counterweight 16 may be attached to track 14 by a length of cable, or may be, for example, a pulley mechanism or spring mechanism 16 attached near the end of track 14, as shown in FIG. 7.

Figure 3:
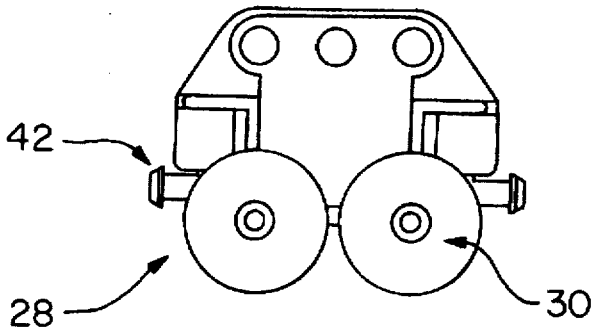
FIG. 3 is a side view of the wheel assembly used in the present trolley system.
Figure 4B:
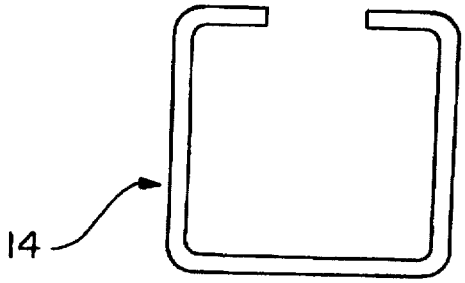
FIG. 4B is an end view of a trolley track used in the invention.
Figure 4A:
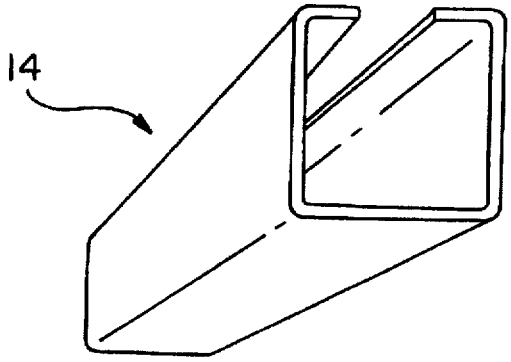
FIG. 4A is a perspective view of a trolley track used in the invention.
Figure 5:
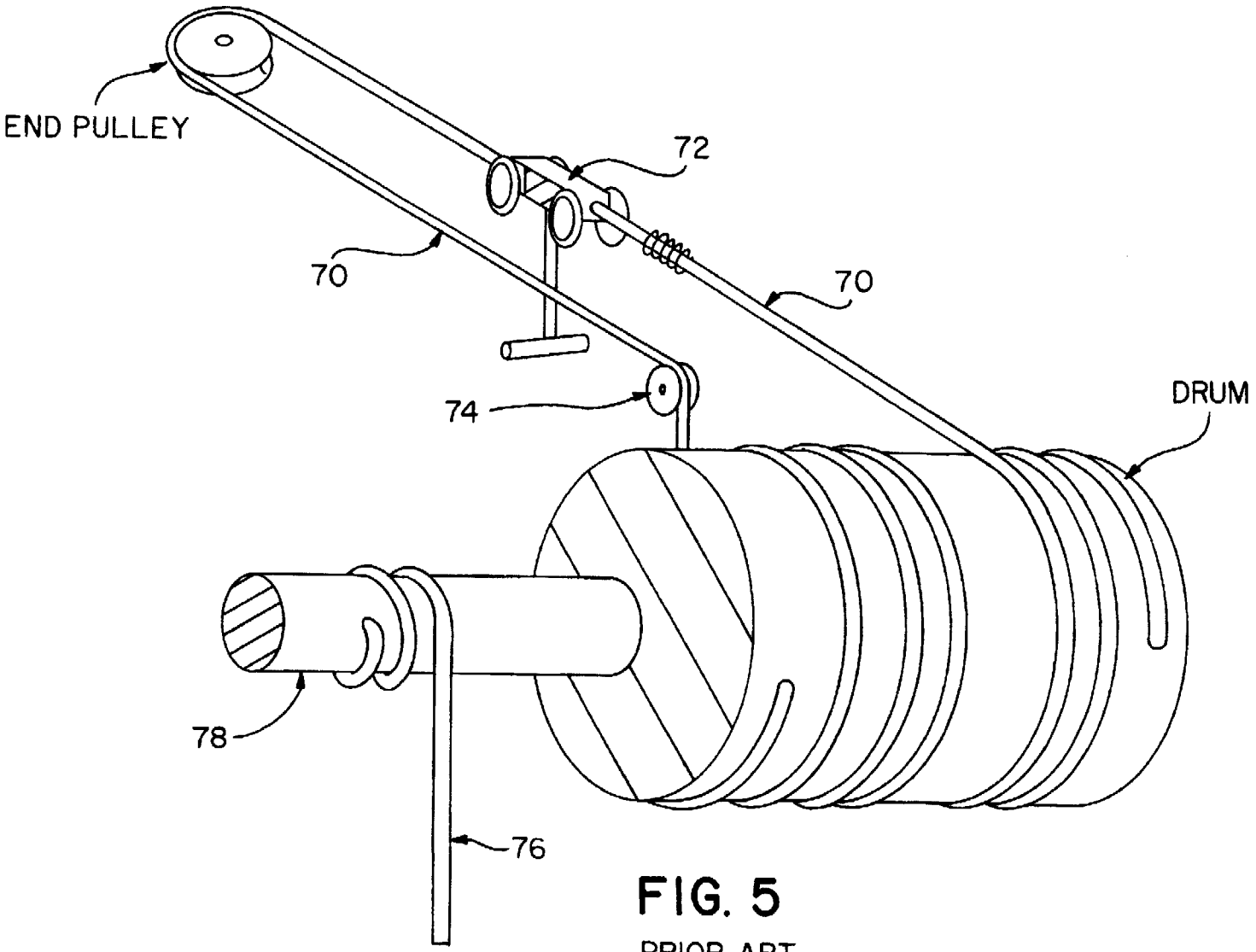
FIG. 5 PRIOR ART
FIG. 5 is a schematic view of a prior art trolley system.

A trolley 18, located on the other side of pivot 10 from counterweight 16, is moveable along track 14 between a return stop 22 and an end stop 24. The portion of track 14 along which trolley 19 rides is preferably constructed of steel Unibilt™ Enclosed Track (Model 20200), such as that shown in FIGS. 4A and 4B, in which the track opening is mounted upward in the preferred embodiment. Trolley 18 preferably rides on a conventional wheel assembly 28, such as the Unibilt™ Hand-Pushed Trolley (Model 20105) shown in FIG. 3. In the preferred embodiment, wheels 30 are mounted downward in track 14. It is foreseen that any appropriate track/trolley combination may be used provided that trolley 18 is able to ride along track 14 with limited friction.

A trolley frame 32 and handle 20 are attached to the wheel assembly 28 by bolts or by any conventionally known means. Handle 20 may be rotatable relative to trolley frame 32 to make the trolley more amusing to children.

In practice, a user of the trolley located on upper platform 4 grasps handle 20 and steps off the platform. Under the weight of the user, track 14 gradually pivots downward causing trolley 18 to slide along the track. As the user approaches lower platform 6, the user will release handle 20. Once the weight of the user is no longer applied to track 14, counterweight 16 will cause track 14 to move upward, thereby returning trolley 18 to return stop 22. The system will then be in a position to be used by the next user.

While track 14 may be of one-piece construction, it is preferably constructed in two sections, pivot section 34 and trolley section 36. Pivot section 34 is preferably constructed of 3.5" square, ¼- wall steel tubing. Trolley section 36 is preferably constructed of the aforementioned Unibilt™ Enclosed Track, which has somewhat smaller dimensions that the tubing of pivot section 34 so that trolley section 36 may be slid into pivot section 34. Pivot section 34 includes a bracket welded at its end, and trolley section 36 includes an identical bracket welded approximately one foot from its end. Trolley bracket 36 is slid into pivot bracket 34 until the brackets meet and are bolted together to form return stop 22. Pivot section 34 is preferably about 6' long, and trolley section 36 is approximately 22' long, including the portion within pivot section 34. It is anticipated that tracks of different lengths may be used in the invention. Also, the precise weight of counterweight 16 will vary depending upon various factors, including the weight of the average user of the system, the length of track 14, and the distance between pivot 10 and counterweight 16.

If desired, shock absorbers 38 may be mounted to frame 2 adjacent to track 14. Shock absorbers 38 dampen the movement of track 14 to ensure smooth operation of the trolley system.

Toward end stop 24, track 14 may be curved upward slightly, if desired. The end of track 14 adjacent to end stop 24 preferably rides between a pair of frame members 40 that act as a guide to stabilize the end of the track and to prevent lateral movement of the track.

Figure 6:
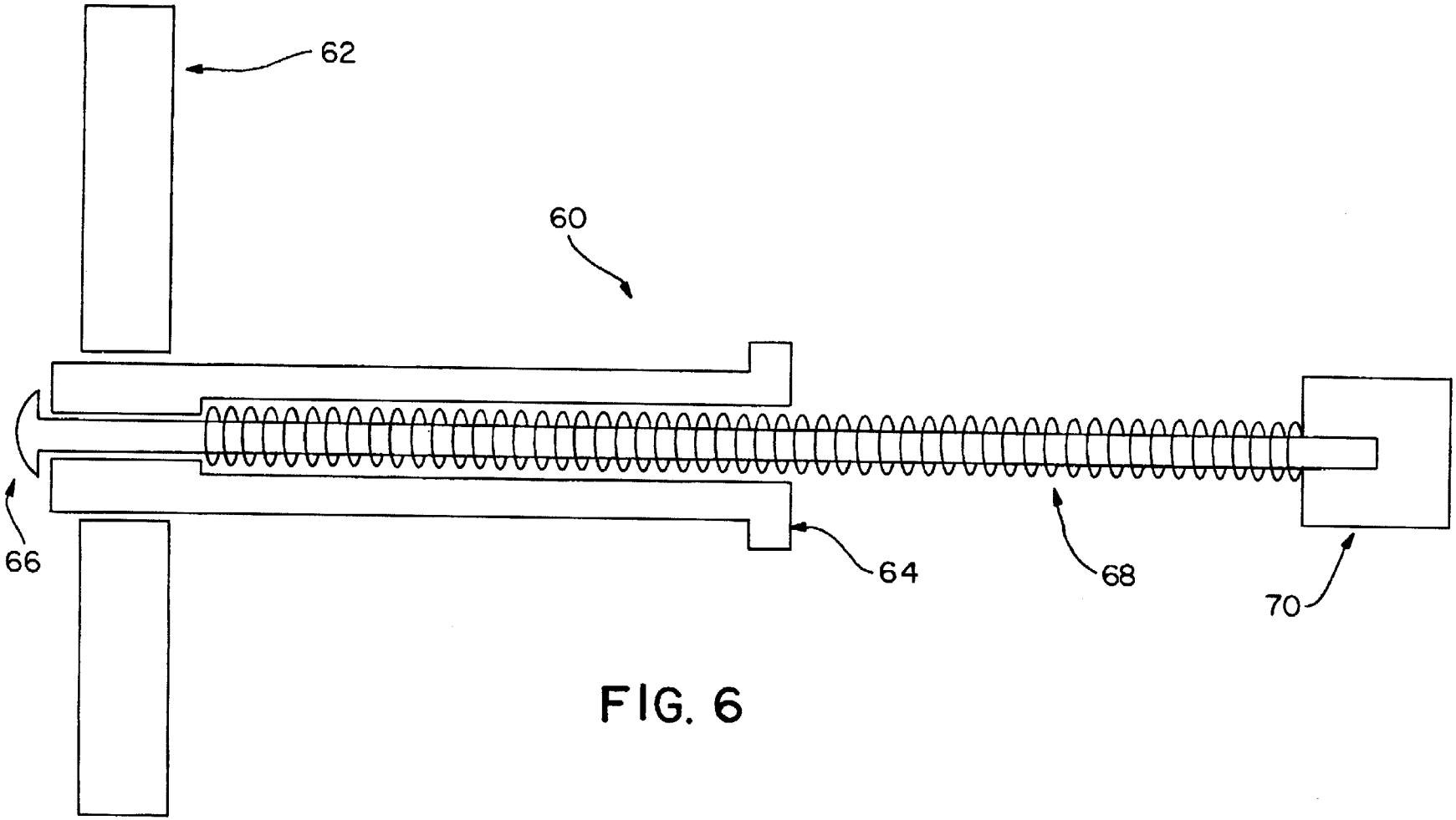
FIG. 6 is a cross-sectional view of a bumper system used in the invention.

Wheel assembly 28 preferably includes at least one bumper 42, preferably constructed of rubber. Bumper 42 cooperates with a spring bumper 60 (FIG. 6) fixedly mounted within track 14 that acts as an end stop. Bumper 60 includes a mounting plate 62 that is welded onto track 14. A bolt 64, preferably a 5-½"×1" diameter bolt, is screwed into a hole in mounting plate 62. Bolt 64 can be screwed into and out of mounting plate 62 to adjust the bumper mechanism. A pan-head bolt 66 extends through the hole in bolt 64. A spring 68 is retained on pan-head bolt 66 by means of a rubber bumper 70 screwed onto pan-head bolt 66. As the trolley approaches the end of track 14, the bumpers on the wheel assembly contact bumper 70, causing spring 68 to compress causing the trolley to bounce back from the end. A similar spring return system (not shown) is mounted near return stop 22 preferably either within track 14 or connected to return stop 22.

Various modifications to the system are foreseen. For example, a seat or carriage may be attached to trolley 18 in lieu of handle 20. Thus, users would sit on the seat as they moved along track 14. Also, pivot bracket 8 could be located below track 14 rather than above it, as shown in FIG. 7. Moreover, while the present invention is particularly suitable as a recreational device, it may also be used for any application requiring a trolley of the type set forth herein.

Although the present invention has been described in detail with respect to certain embodiments and examples, variations and modifications exist which are within the scope of the present invention as defined in the following claims.

What is claimed is:

1. A trolley system which comprises:

a track having a first end and a second end;

a pivot located between the first and second ends of the track whereby downward movement of the first end of the track causes upward movement of the second end of the track;

a counterforce located toward the first end of the track for applying a downward force to the first end of the track; and a trolley mounted on the track and movable along a portion of the track located between a starting position and the second end of the track, the starting position located between the pivot and the second end, the trolley comprising user riding means, the combined weight of a user and the user riding means being sufficient overcome the counterforce so as to move the second end of the track downward to enable the trolley to move along the track toward the second end, the counterforce being sufficient to move the second end of the track upward to a slightly horizontally upward inclined position from the pivot so as to return the trolley to the starting position when the weight of the user is released from the trolley.

2. The trolley system according to claim 1 wherein the counterforce is a counterweight.

3. The trolley system according to claim 2 wherein the counterweight is fixed to the first end of the track.

4. The trolley system according to claim 1 wherein the counterforce comprises springs or pulleys.

5. The trolley system according to claim 1 wherein the trolley comprises a wheel assembly movable on or within the track.

6. The trolley system according to claim 1 wherein the pivot is mounted below the track.

7. The trolley system according to claim 1 wherein the pivot is mounted above the track.

8. The trolley system according to claim 1 further comprising a first platform located near the starting position at a height at which the user riding means is within reach of a user; and a second platform spaced within reach of a user from the user riding means in a downward position of the track.

9. The trolley system according to claim 1 further comprising shock absorber means for damping movement of the track.

10. The trolley system according to claim 1 further comprising a guide track for stabilizing the second end of the track.

11. The trolley system according to claim 1 further comprising spring end-stop means at the starting position and at the second end of the track.

12. The trolley system according to claim 1 wherein the track is curved slightly upward toward the second end thereof.

* * * * *

UNITED STATES PATENT AND TRADEMARK OFFICE

CERTIFICATE OF CORRECTION

PATENT NO. : 5,638,755

DATED : June 17, 1997

INVENTOR(S) : Randy H. Love

It is certified that error appears in the above-indentified patent and that said Letters Patent is hereby corrected as shown below:

On title page, item [75] should read;

[75] Inventors: Randy H. Love, Camden, Mo.

Signed and Sealed this

Twelfth Day of August, 1997

Bruce Lehman

*Attest:*

BRUCE LEHMAN

*Attesting Officer*

*Commissioner of Patents and Trademarks*